US008327857B2

(12) United States Patent
Aghilabadi

(10) Patent No.: US 8,327,857 B2
(45) Date of Patent: Dec. 11, 2012

(54) METHOD OF APPLYING A HAIR-CARE PRODUCT TO A HARD-TO-VIEW PORTION OF A PERSON'S HEAD USING A DISPENSING BOTTLE HAVING A MIRROR ATTACHED TO THE DISPENSING BOTTLE

(76) Inventor: Fereshteh Aghilabadi, New York, NY (US)

( * ) Notice: Subject to any disclaimer, the term of this patent is extended or adjusted under 35 U.S.C. 154(b) by 183 days.

(21) Appl. No.: 12/699,914

(22) Filed: Feb. 4, 2010

(65) Prior Publication Data

US 2011/0186069 A1 Aug. 4, 2011

(51) Int. Cl.
*A45D 7/00* (2006.01)

(52) U.S. Cl. ..... 132/200; 132/316

(58) Field of Classification Search ..... 132/200, 132/286, 291, 316; 222/192
See application file for complete search history.

(56) References Cited

U.S. PATENT DOCUMENTS

| | | | | |
|---|---|---|---|---|
| 2,294,212 | A * | 8/1942 | Scharff | 132/316 |
| 2,951,584 | A * | 9/1960 | Bauer | 401/59 |
| 3,506,001 | A | 4/1970 | Costello | |
| 3,640,274 | A | 2/1972 | Costello | |
| 3,913,575 | A | 10/1975 | Windsor | |
| 4,119,107 | A * | 10/1978 | Pinzone et al. | 132/316 |
| 4,716,915 | A | 1/1988 | Burns | |
| 4,837,861 | A | 6/1989 | Cole | |
| 5,018,543 | A | 5/1991 | Trillo Martinez et al. | |
| 5,607,410 | A | 3/1997 | Branch | |
| 5,976,116 | A | 11/1999 | Muroff | |
| 6,325,784 | B1 | 12/2001 | Muroff | |

FOREIGN PATENT DOCUMENTS

| | | | |
|---|---|---|---|
| CN | 01072097 | A | 5/1993 |
| CN | 02399984 | Y | 10/2000 |
| CN | 21143296 | Y | 11/2008 |

OTHER PUBLICATIONS http://www.promopeddler.com/diva/diva-water-bottle-mirror-ounce-qqp338740.htm Downloaded on Oct. 13, 2009 Corporate Logo Diva—Water bottle w/ mirror, 22 ounce.

* cited by examiner

*Primary Examiner* — Rachel Steitz
(74) *Attorney, Agent, or Firm* — Russ Weinzimmer; Russ Weinzimmer & Associates PC

(57) ABSTRACT

Dispensing bottles with an attached adjustable mirror for controllably dispensing a fluid to a location viewable with the adjustable mirror are discussed and illustrated. The mirror may be attached to the dispensing bottle with a mirror support assembly that can allow the mirror to be adjusted so a person using the dispensing bottle can see where they otherwise could not see without having to hold the mirror separately from the dispensing bottle. The mirror support assembly can also be manipulated so as to retract the mirror into a position adjacent and substantially parallel to a sidewall surface of the dispensing bottle.

2 Claims, 6 Drawing Sheets

METHOD OF APPLYING A HAIR-CARE PRODUCT TO A HARD-TO-VIEW PORTION OF A PERSON'S HEAD USING A DISPENSING BOTTLE HAVING A MIRROR ATTACHED TO THE DISPENSING BOTTLE

FIELD

This application relates generally to dispensing bottles and in particular, to dispensing bottles adapted for precise application of fluid to a selected location.

BACKGROUND

Hair care and styling is extremely important to many people who desire to present a certain appearance in public. Hair is one of the most noticeable features of an individual, and as a result, billions of dollars are spent each year on hair-care products and treatments. Additionally, a significant amount of time is spent by many each day in caring for and styling their hair.

Since it is difficult for a person to see the back of their own head, styling their own hair can involve using multiple mirrors, hair-care products, and hair-care devices, generally at the same time. It can be extremely difficult to simultaneously manage a hand-held mirror, hair care product (such as hairspray, touch-up dye, leave-in conditioner, etc.) and a brush, to style certain portions of the hair. As such, individuals may often be forced to guess about where and how hair-care products are actually being applied. Often, this approach requires additional effort to fix problems caused by not being able to view the area of application of the hair-care product.

Some hair-care products, such as touch-up hair dye, may require frequent application and can also require two hands to be properly applied without undesired dying of other hair, or wasting or spilling of the product. This causes some people to seek assistance from other people to aid them in properly applying the dye to a selected location, resulting in frequent and costly visits to a stylist or beautician.

SUMMARY

Embodiments of a dispensing device for controllably dispensing a fluid to a selectable location may include a dispensing bottle, a mirror, and a mirror support assembly connecting the mirror to the dispensing bottle. The mirror support assembly may be manipulatable so as to hold the mirror at a selectable location and orientation with respect to the dispensing bottle. The mirror support assembly can also be manipulated so as to retract the mirror into a position adjacent and substantially parallel to a sidewall surface of the dispensing bottle.

In some embodiments, the mirror support assembly includes at least one arm and at least two joints, and the arm may have a variable length. The mirror support assembly may be attached to a shoulder of the dispensing bottle through a joint. At least one of the joints may be a ball and socket joint. Similarly, at least one joint may incorporate sufficient internal friction so as to enable the mirror support assembly to hold the mirror at a selectable location and orientation with respect to the dispensing bottle.

In some embodiments, the mirror support assembly includes a reinforcing ring affixed to a shoulder of the dispensing bottle. The reinforcing ring may provide a stable and robust point of attachment for a joint of the mirror support assembly, and may be removably affixed to the shoulder. In some embodiments, the mirror may be double sided, with one side having a magnification to improve detailed viewing.

The dispensing device may be used to apply a hair-care product to a hard-to-view portion of a person's head by providing a dispensing bottle containing the hair-care product and having a mirror attached to the dispensing bottle via a mirror support assembly, extending the mirror away from the dispensing bottle, orienting the mirror, using the mirror support assembly, and applying the hair-care product to the hard-to-view portion of the head, while viewing the hard-to-view portion of the head with the mirror.

BRIEF DESCRIPTION OF THE DRAWINGS

The following description can be better understood in light of Figures, in which.

Figure 1:
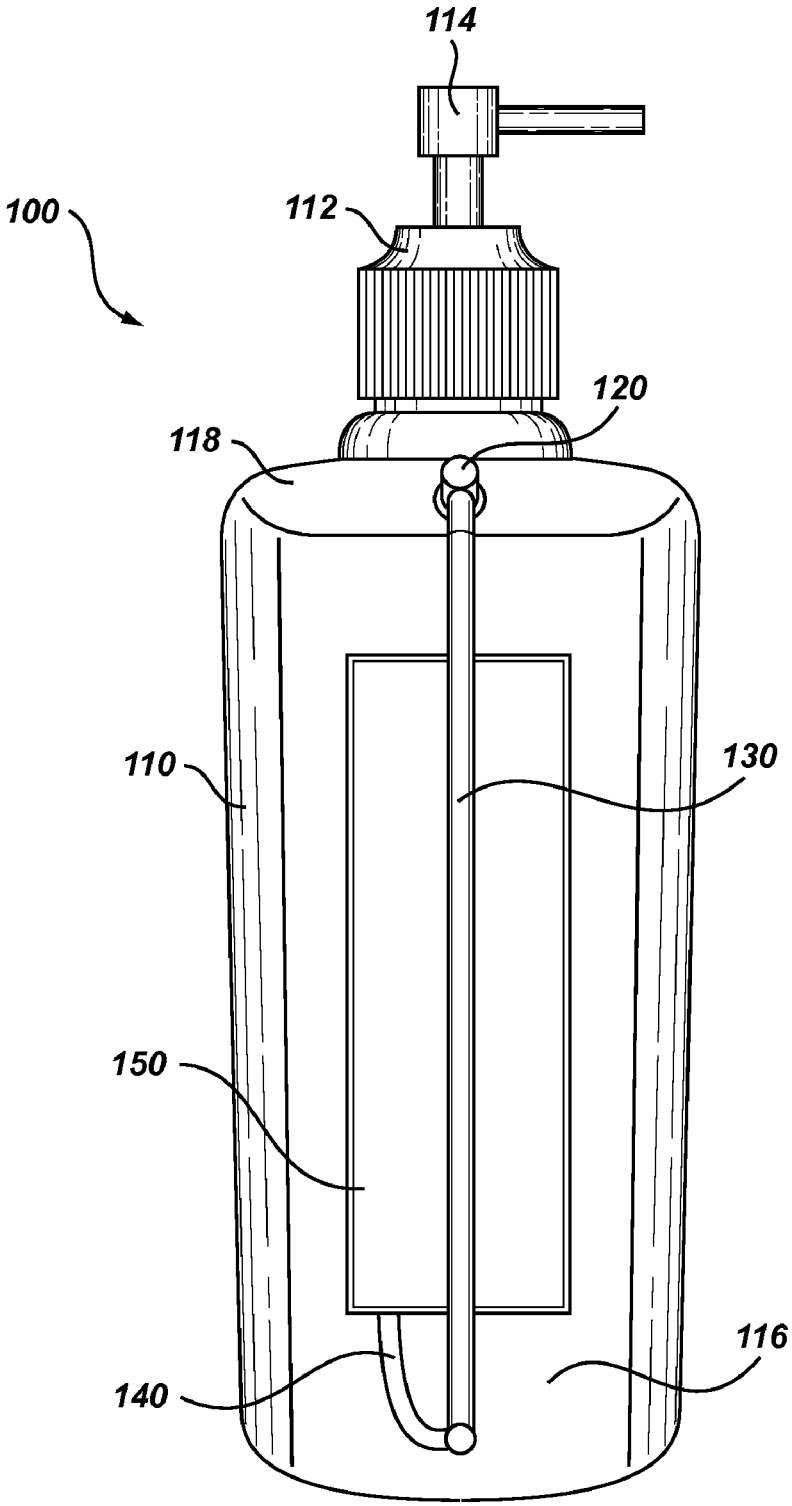
FIG. 1 is an illustration of an exemplary embodiment of a dispensing bottle with an adjustably attached mirror.

Together with the following description, the Figures demonstrate and explain the principles of inventive dispensing bottles with attached mirrors and methods for using and making the devices. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that embodiments of dispensing bottles with attached mirrors and associated methods of using the devices can be implemented and used without employing these specific details. Indeed, exemplary embodiments and associated methods can be placed into practice by modifying the illustrated units and associated methods and can be used in conjunction with any other devices and techniques conventionally used in the industry. For example, while the description below focuses on a dispensing bottle with a flow tip for use with haircare, the apparatus and associated methods could be equally applied with other situations, such as spray bottles, pump bottles, and other dispensing bottles.

Figure 2:
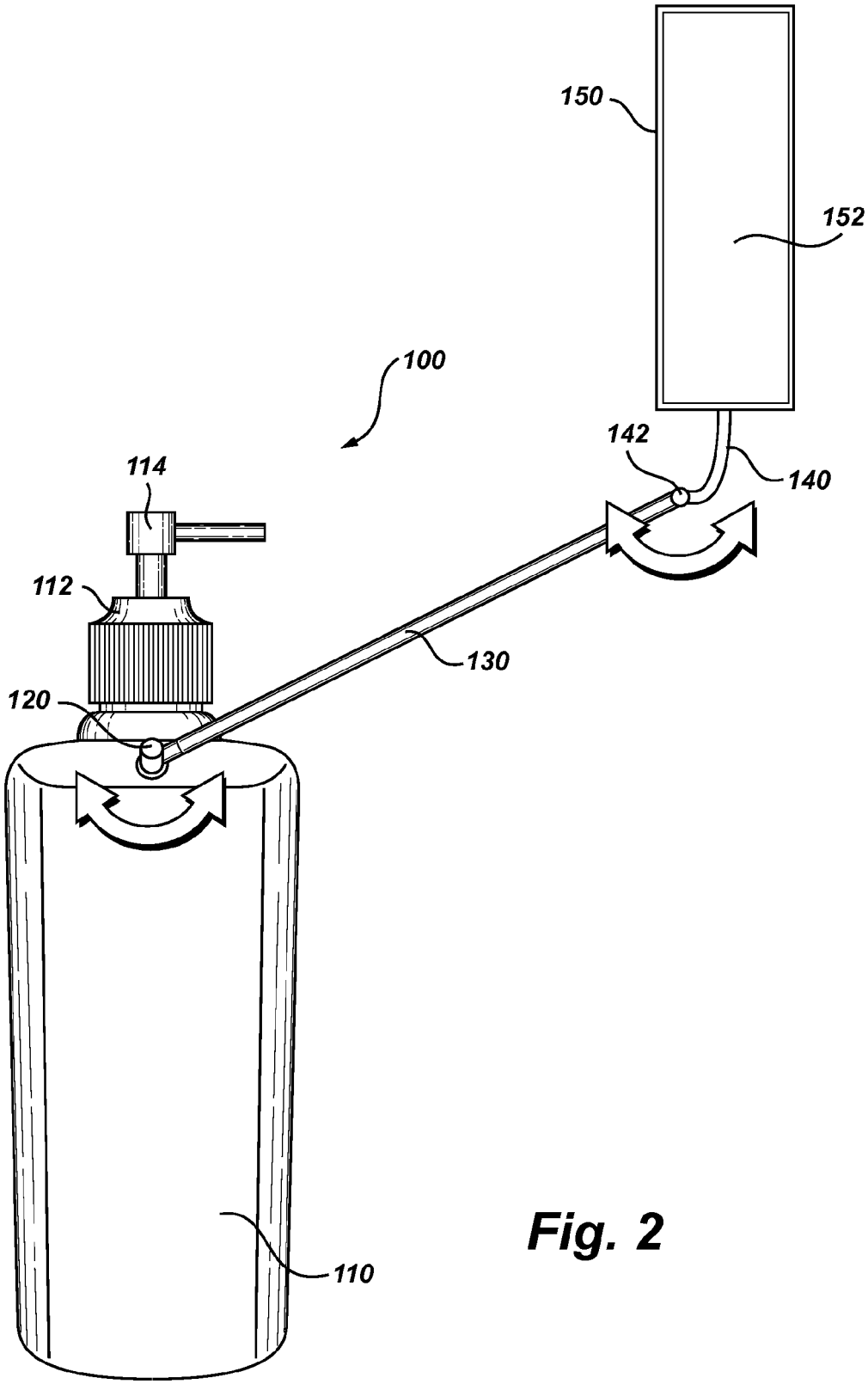
FIG. 2 is an illustration of the dispensing bottle of FIG. 1 with the adjustable attached mirror in an extended position.

One exemplary dispensing bottle with attached mirror is illustrated in FIGS. 1-2. In the Figures, dispensing bottle with attached mirror support assembly 100 is shown. Mirror support assembly 100 includes dispensing bottle 110, attachment 120, arm 130, mirror arm 140, and mirror body 150. Dispensing bottle 110 may be any dispensing bottle, such as a plastic bottle, a pressurized spray can, or any other dispensing bottle. Dispensing bottle 110 may have any shape, such as cylindrical, rectangular block, triangular block, rounded with stylized contours, or any other dispensing bottle design. Similarly, dispensing bottle 110 may be formed of any suitable material, such as plastic, metals, ceramics, etc., depending on the desired appearance and contents. In the illustrated embodiments, dispensing bottle 110, 210 is generally a rectangular block having a generally flat surface 116, 216 against which mirror body 150, 250 may be closely situated.

Dispensing bottle 110 may include cap 112 and nozzle 114 for dispensing a product from dispensing bottle 110. In the illustrated embodiments, nozzle 114 is may be a free-flow nozzle that allows fluid to leave dispensing bottle 110 when nozzle 114 is open and dispensing bottle 110 is inverted. In other embodiments, nozzle 114 may be a pump-spray nozzle, a compressed-gas nozzle, pump-nozzle, or any other desired dispensing nozzle. In some embodiments, cap 112 may be removable, or may be formed as part of dispensing bottle 110, such as when dispensing bottle 110 is a pressurized spray can.

Attachment 120 may provide attachment between arm 130 and dispensing bottle 110. Attachment 120 allows arm 130 and thus mirror body 150 to rotate away from surface 116, while providing sufficient friction to allow mirror body 150 to be accommodated in any desired extended position, such as that shown in FIG. 2, without the need to manually hold arm 130 in a particular position. Attachment 120 may be any type of attachment suitable to function as described. Various embodiments of attachments are described below with respect to subsequent illustrated embodiments.

Figure 3:
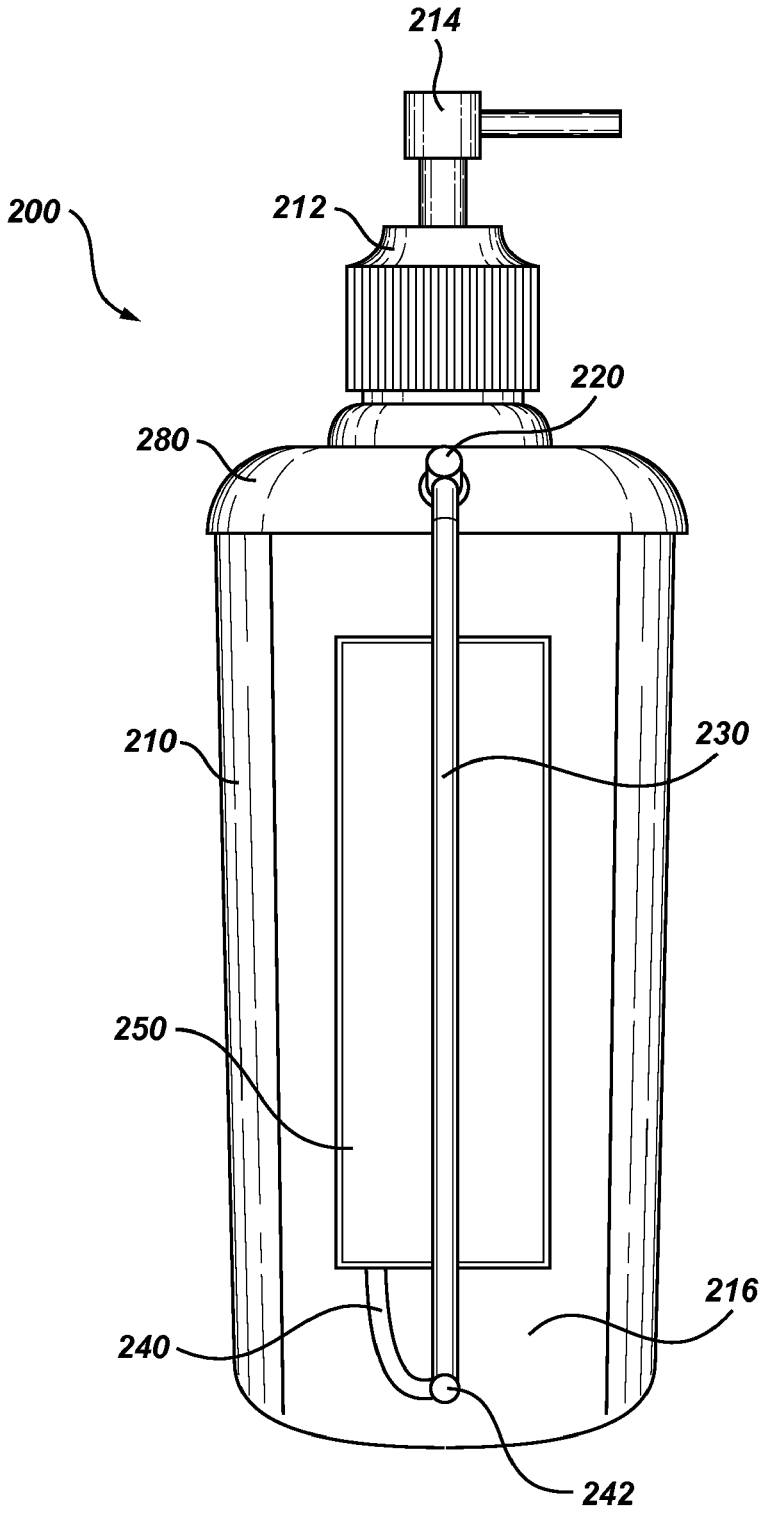
FIG. 3 is an illustration of an exemplary embodiment of a dispensing bottle with an adjustably attached mirror, the mirror being attached to a ring incorporated on the bottle body.

Attachment 120 may be placed anywhere on dispensing bottle 110. In the Illustrated embodiment, attachment 120 is located at the edge of flat surface 116, near the top of dispensing bottle 120. In some embodiments, attachment 120 may be located on top 118, cap 212, or other portion of dispensing bottle 110. All or a portion of attachment 120 may be formed in dispensing bottle 110 to provide attachment for arm 130. In some embodiments, attachment 120 may be affixed to dispensing bottle 120. FIG. 3 illustrates attachment 220 on ring 280, which will be described in further detail below.

Arm 130 may connect mirror arm 140 with attachment 120. Arm 130 may have any desired length. Arm 130 as illustrated has a length slightly shorter than the height of dispensing bottle 110, providing a compact package when arm 130 and mirror body 250 are in a retracted position, as shown in FIG. 1. In some embodiments, arm 130 may be telescoping such that arm 130 has a variable length.

Mirror arm 140 may be connected to arm 130 through joint 142 and to mirror body 150. Mirror arm 140 may have any shape or design desired to allow placement of mirror body 150 when mirror support assembly 100 is used. In some embodiments, additional support assembly elements may be provided to allow mirror body 150 to be extended to a desired length from dispensing bottle 110. For example, arm 130 may include two or more segments joined by joints to allow for various positioning.

Mirror body 150 provides a base for mirror 152. Mirror base 150 and mirror 152 may be of any desirable size. Mirror base 150 may be formed to conform to surface 116 when in a retracted position, such as is shown in FIG. 1. This shape may provide for compact and efficient storage and shipment of mirror support assembly 100. In some embodiments, mirror base may be hinged to provide a larger mirror when in an extended position, similar to that shown in FIG. 2. In some embodiments, mirror base may be omitted, the mirror being directly connected to mirror the mirror arm, or to arm 130. Similarly, in some embodiments, mirror base 150 may include mirrors on both sides to provide additional viewing options. In such embodiments, one mirror may magnify the image to allow for more detailed viewing of a desired location.

Figure 2A:
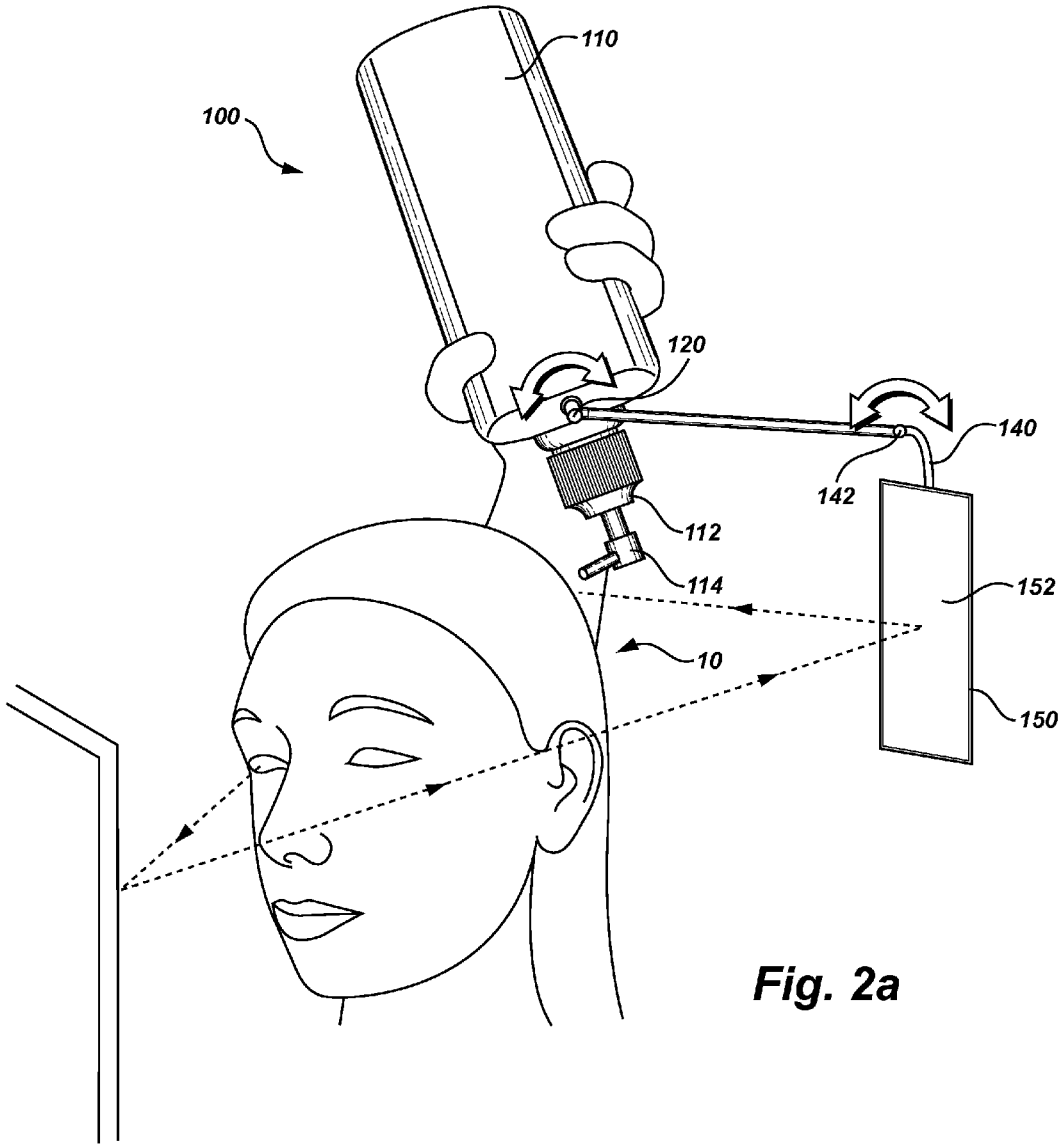
FIG. 2*a* is an illustration of the dispensing bottle of FIG. 1 with the adjustable attached mirror in an extended position, and with the dispensing bottle in use.

As shown in FIGS. 2 and 2*a*, mirror base 150 may be extended from dispensing bottle 110 by moving the various components as shown in the movement arrows in FIG. 2. Dispensing bottle 110 may then be used to dispense product through nozzle 114 onto the user 10 while mirror 152 may be used to see an area being treated. This can allow user 10 to use one hand guiding dispensing bottle 110 and freeing the other hand to use a brush, comb, towel, or some other implement or device to assist in the correct application of the contents of dispensing bottle 110.

Figure 4:
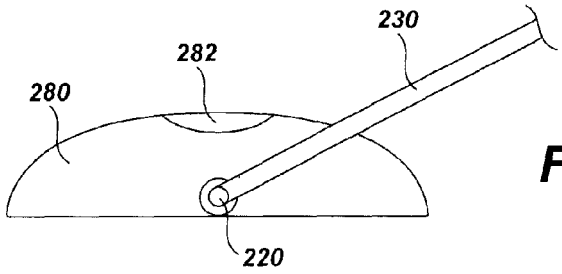
FIGS. 4 and 5 are illustrations of a connection mechanism of the dispensing bottle of FIG. 3.
Figure 5:
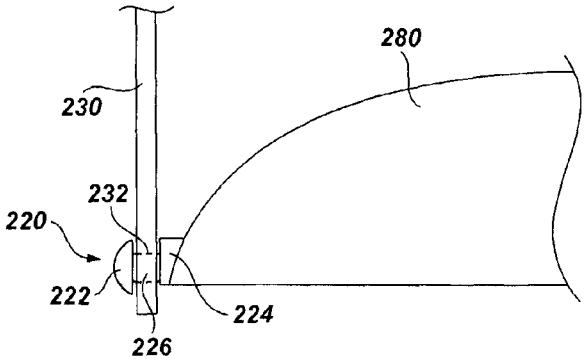

FIG. 3 illustrates mirror support assembly 200 in a retracted position, which includes the same general components as mirror support assembly 100, with corresponding features being similar. Mirror support assembly 200 also includes ring 280, which is illustrated in FIGS. 3-5. Ring 280 may be placed over a portion of dispensing bottle 210, such as a top portion. Cap 212 and nozzle 214 may extend through hole 282 in ring 280, allowing ring 280 to be placed over the top of dispensing bottle 210.

Ring 280 may be formed such that it has a cooperative fit with the top, or other portion, of dispensing bottle 210. In some embodiments, hole 282 of ring 280 and cap 212 may be sized such that ring 280 can be placed on dispensing bottle 210 and then held in place by cap 212, with cap 212 having a larger diameter than the diameter of hole 282. Ring 280 may also be placed on the bottom of dispensing bottle 210 and shaped accordingly, or in the middle of bottle 210, as desired. Attachment 220 may be formed into ring 280, or may be otherwise affixed to ring 280.

Figure 6:
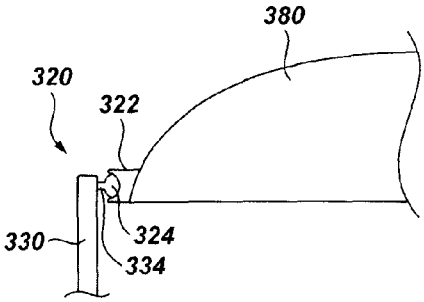
FIG. 6 is an illustration of a connection mechanism of a dispensing bottle with an adjustably attached mirror.
Figure 7:
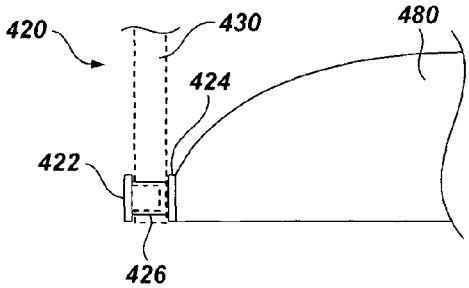
FIG. 7 is an illustration of a connection mechanism of the dispensing bottle with an adjustably attached mirror.

FIGS. 5-7 illustrate embodiments of attachments similar to attachment 120. Each of the embodiments may be used as desired with the embodiments of FIGS. 1-4. FIG. 5 illustrates attachment 220 formed into ring 280. Attachment 220 includes base 224, shaft 226 and retainer 222. In the embodiment illustrated in FIG. 5, arm 230 includes hole 232 that allows passage of retainer 222 therethrough. Retainer 222 may be formed to allow for deformation when being pushed through hole 232, and then providing a lip to retain arm 230 in place. Shaft 226 may be of a length slightly shorter than the width of arm 230 to provide friction sufficient to hold arm 230 in any desired position. Attachment 220 may allow for rotation of arm 230 about shaft 226.

FIG. 6 illustrates an embodiment of attachment 320 that may be used with ring 380, having similar function and elements to ring 280. Attachment 320 may include a ball and socket joint that has socket 322, ball 324, and shaft 334. Ball 324 and shaft 334 may be located on linkage 330. Attachment 320 may provide extensive motion of linkage 320 to be positioned as desired. The fit between ball 324 and socket 322 may be sized to provide sufficient friction to allow linkage 330 to be held in any desirable position.

FIG. 7 illustrates another embodiment of an attachment for connecting a linkage arm to a dispensing bottle or ring, such as dispensing bottles 110, 210 and ring 280. Attachment 420 is similar to attachment 220, except that fastener 422 may be inserted into shaft 426 to provide friction between fastener 422 and base 424 and linkage 430, allowing linkage 430 to be held in a desirable position with respect to ring 480. Fastener 422 may be a screw to allow for adjustment of the friction.

Figure 8:
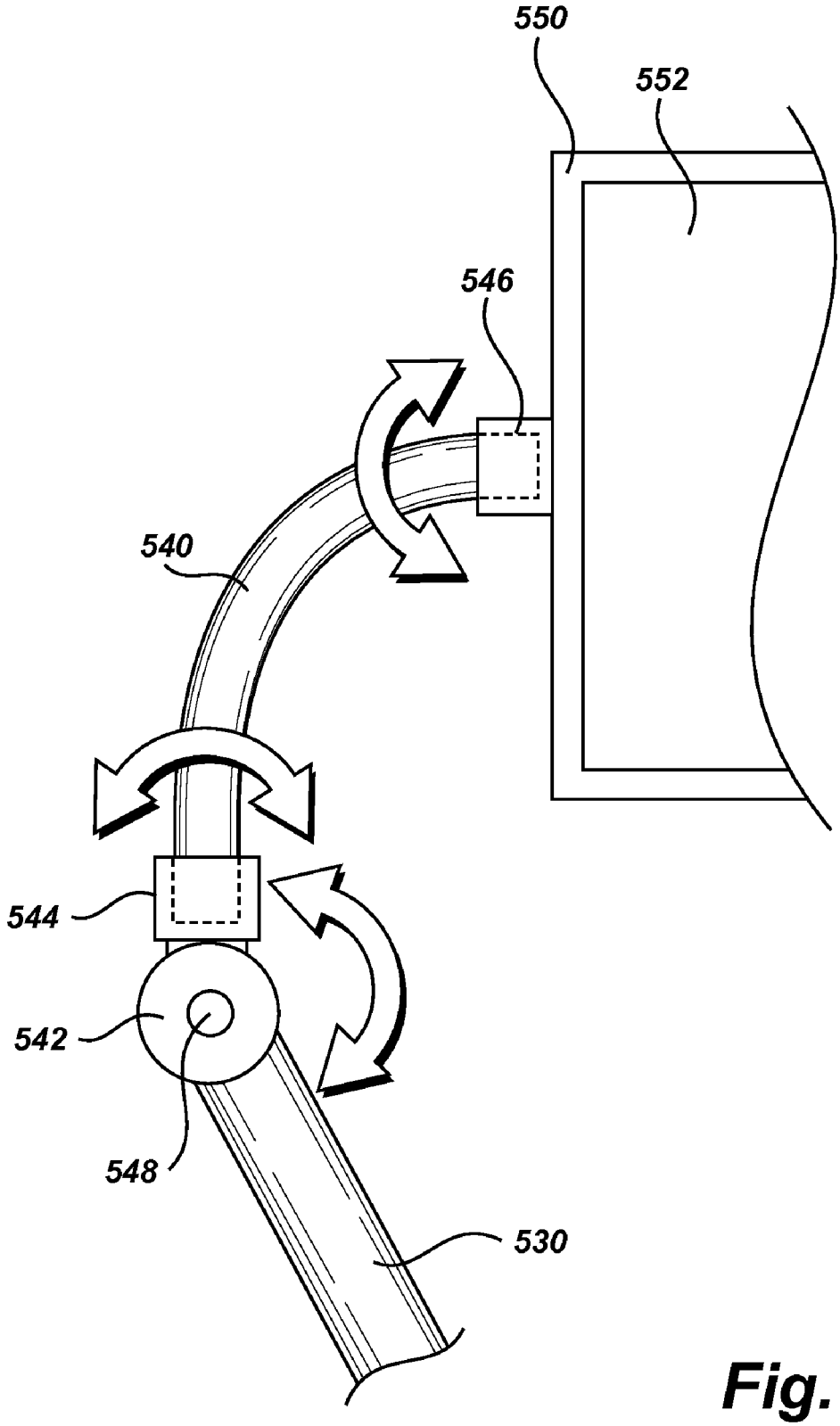
FIG. 8 is an illustration of an exemplary linkage between a dispensing bottle and an adjustably attached mirror.

FIG. 8 illustrates embodiments of connection relationships between linkage 530, mirror arm 540, and mirror base 550. Each of the features shown in FIG. 8 may be used, either alone or in combination, with the embodiments shown in FIGS. 1-7 and described above. Linkage 530 may be connected to joint

542, which may be rotate about pin 548. In some embodiments, joint 142, 542 may be a ball and socket joint, or any other type of joint as desired. Joint 542 may be connected to mirror arm 540 with rotational joint 544. Similarly, rotational joint 546 may connect mirror body 552 to mirror arm 540, allowing mirror body 552 to be rotated in about different axes, reflected by the rotational arrows in FIG. 8. Other connection between various members may include different types of connections and joints, as desired.

In some embodiments, the mirror 550, 552 may be removable at any of the joints or attachment points discussed above or presented in the Figures. For example, mirror base 550 may be selectively removed from mirror arm 540 at rotational joint 546, or mirror arm 540 may remain attached to mirror base 550 and be disconnected from linkage 530, allowing mirror arm 540 to be used as a handle. Similarly, ring 280, 380, 480 may be removed from the bottle to provide for the mirror 550, 552 being positioned separately from the bottle.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

What is claimed is:

1. A method of applying a hair-care product to a hard-to-view portion of a person's head, the method comprising:

providing a dispensing bottle containing the hair-care product, and having a mirror attached to the dispensing bottle via a mirror support assembly which connects the mirror to the dispensing bottle;

extending the mirror away from the dispensing bottle, and orienting the mirror, using the mirror support assembly; and applying the hair-care product to the hard-to-view portion of the head, while viewing the hard-to-view portion of the head with the mirror.

2. The method of claim 1, further comprising placing the mirror in a retracted position after the applying is completed.

* * * * *